United States Patent [19]

Ritter

[11] Patent Number: 4,598,789

[45] **Date of Patent: * Jul. 8, 1986**

[54] SOUND REPRODUCING

[75] Inventor: David W. Ritter, Holmes, Pa.

[73] Assignee: Temporal Dynamics Research, Inc., Aston, Pa.

[ * ] Notice: The portion of the term of this patent subsequent to Aug. 21, 2001 has been disclaimed.

[21] Appl. No.: 585,386

[22] Filed: Mar. 2, 1984

Related U.S. Application Data

[63] Continuation-in-part of Ser. No. 369,825, Apr. 19, 1982, Pat. No. 4,466,505.

[51] Int. Cl.[4] ..... H05K 5/00

[52] U.S. Cl. ..... 181/144; 181/155

[58] Field of Search ..... 181/144, 145, 146, 148, 181/155, 156, 199

[56] References Cited

U.S. PATENT DOCUMENTS

| | | | |
|---|---|---|---|
| 1,932,343 | 10/1933 | Holland | 181/144 |
| 2,713,396 | 7/1955 | Tavares | 181/163 X |
| 3,169,601 | 2/1965 | Smith | 181/156 |
| 3,603,427 | 9/1971 | Sotome | 181/166 |
| 3,903,989 | 9/1975 | Bauer | 181/144 |
| 3,945,461 | 3/1976 | Robinson | 181/153 |
| 3,964,571 | 6/1976 | Snell | 181/144 |
| 4,016,953 | 4/1977 | Butler | 181/144 |
| 4,029,170 | 6/1977 | Phillips | 181/155 |
| 4,100,992 | 7/1978 | Rehde et al. | 181/166 |
| 4,196,792 | 4/1980 | Grieves et al. | 181/156 |
| 4,437,541 | 3/1984 | Cross | 181/151 |
| 4,440,259 | 4/1984 | Strohbeen | 181/146 |

*Primary Examiner*—L. T. Hix
*Assistant Examiner*—Brian W. Brown
*Attorney, Agent, or Firm*—Connolly and Hutz

[57] ABSTRACT

High fidelity combination of low-bulk bass signal reproducer with novel upper range reproducer. Bass reproducer is box whose height, width and depth are each between about 15 and about 21 inches, the bottom of the box being essentially open and fitted with spaced feet on which the box can stand on a pile rug without materially blocking the emergence of sound generated within the box, the top and all sides of the box being essentially imperforate essentially rigid walls which essentially do not transmit sound, and a woofer sound generator mounted within the box. The box can have a generally vertically extending partition that forms a generally vertically extending open-bottomed compartment between 1 and 2 inches thick connected as a duct to conduct and discharge the lowest frequency sounds generated by the woofer. Upper range reproducer has a face panel holding at least one outwardly facing sound generator, and a speaker grill covering the face panel, the improvement according to which the grill is mounted on a peripheral frame that encircles the panel and is closely fitted around the panel so that it can be slidably installed over the panel and slidably removed from the panel. The face panel can be spaced from a back panel with cross-over and/or compensation network secured in that space, and back panel can be recessed to receive fuses and make circuit components available.

2 Claims, 9 Drawing Figures

110
308
302
300
14
24
304
306
10
52
51
200
211
212
213
214
215
216
217
218
Left
Right
From Amplifier
221
222
223
224
225
226
227
228
230
231
232
233
234
236
238
240
242
244
246
248
250
252
254
256
258
260
262
264
266
268
270
272
273
274
276
280
282
284
286
150
142
Right

SOUND REPRODUCING

This application is a continuation-in-part of application Ser. No. 369,825 filed Apr. 19, 1982 (now U.S. Pat. No. 4,466,505 granted Aug. 21, 1984).

The present invention relates to sound reproducers, more particularly sound reproducers using loudspeakers or speakers in radio and recorder sound outputs.

Among the objects of the present invention is the provision of novel sound reproducer combinations that are very effective in faithfully reproducing the desired sounds.

Additional objects of the present invention include high quality sound reproducer constructions that are relatively small in size.

The foregoing as well as still further objects of the present invention will be more fully demonstrated in the following description of several of its exemplifications, reference being made to the accompanying drawings wherein.

The sound reproducer combination of the present invention is of the so-called high fidelity type intended to faithfully reproduce sounds in the usual type of living room of a home. Such a room is generally at least about 12 feet by 18 feet in floor size and about 8 feet high, and the floor is frequently covered by a rug, particularly one having substantial pile. The sounds to be reproduced are generally those from the electrical output of a radio, record player or tape recorder or the like, and have a range of frequencies from as low as about 20 hertz to as high as about 20 kilohertz.

Faithful response of a speaker calls for reproduction of all audible frequencies at the correct amplitude, as well as accurate reproduction of rise and decay times for all such signals and spacial distribution of the reproduced sound in a manner closely corresponding to that of the original sounds.

Loudspeakers or speakers have long been used as sound reproducers, different kinds being adapted to reproduce the different frequencies. While the art has developed relatively inexpensive amplifiers that do a very good job of providing the electrical signals for high quality sound, the necessary speaker systems have generally been quite expensive as well as bulky. This is particularly true of stereo systems, where two separate sound reproducing systems are used to separately reproduce a pair of stereo sounds. Even these expensive and bulky systems generally fail to faithfully reproduce sound in the comprehensive sense discussed above.

The bulkiest portion of such systems is the woofer, which is supposed to reproduce sounds having frequencies below about 200 to 300 hertz. According to the present invention a woofer sound generating combination has an essentially rigid generally rectangular box whose height, width and depth are each between about 15 and about 21 inches, the bottom of the box being essentially open and fitted with spaced feet on which the box can stand on a pile rug without materially blocking the emergence of sound generated within the box, the top and all sides of the box being essentially imperforate essentially rigid walls which essentially do not transmit sound, and a woofer sound generator mounted within the box.

To reduce the bulk of the sound reproducer for higher frequencies and improve their spacial distribution, a separate mid-range loudspeaker has a cone suspended for vibration in a frame about 4½ inches in diameter and about 2 inches deep, the frame is mounted on a face panel of a shallow box, and the loudspeaker face is covered by a grill cloth, the grill cloth being mounted on a peripheral frame that encircles the panel and is closely fitted around the panel so that it can be slidably installed over the panel and slidably removed from the panel.

Figure 1:
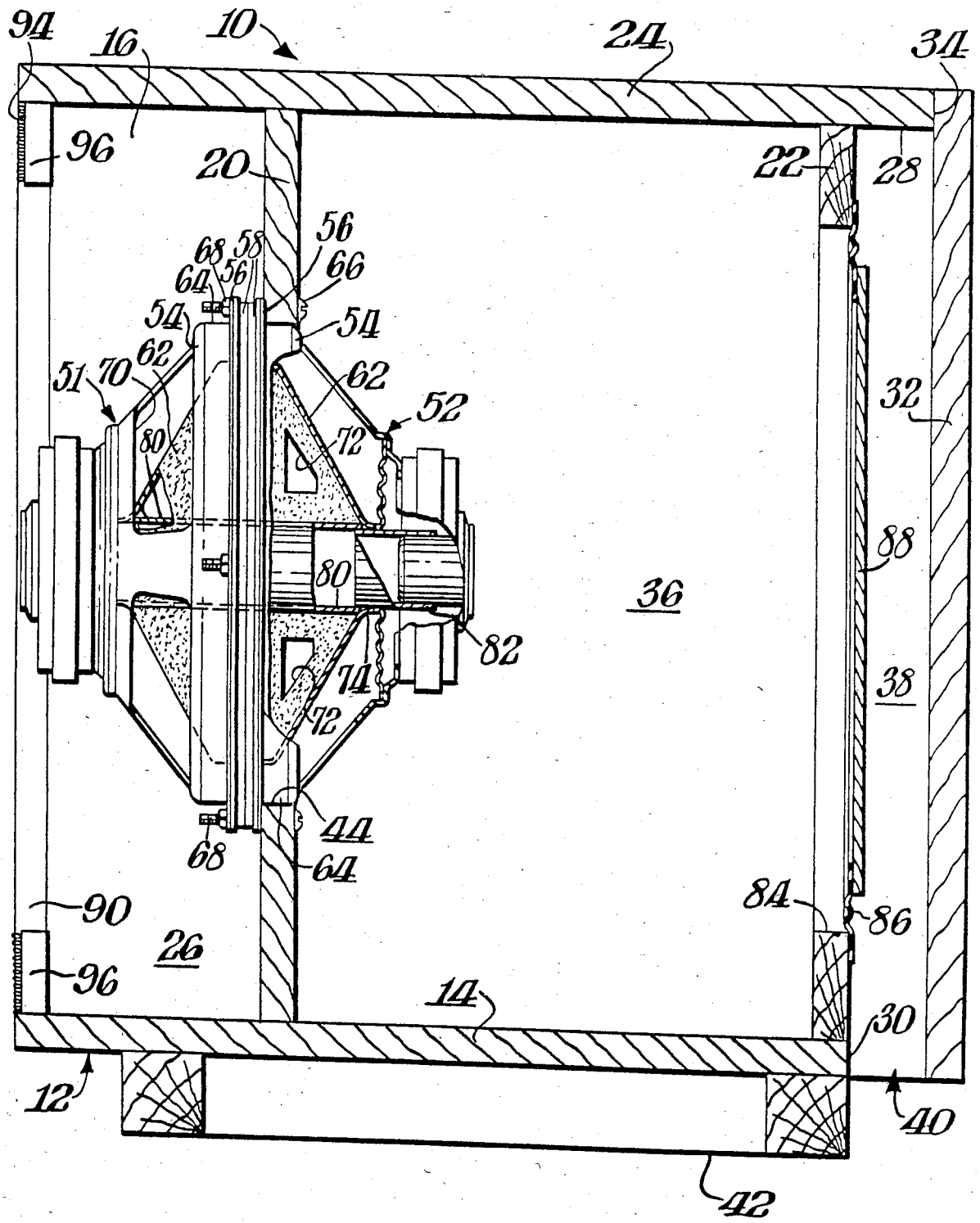
FIG. 1 is a vertical sectional view, with parts broken away, of a woofer type sound reproducer combination according to the parent application.
Figure 2:
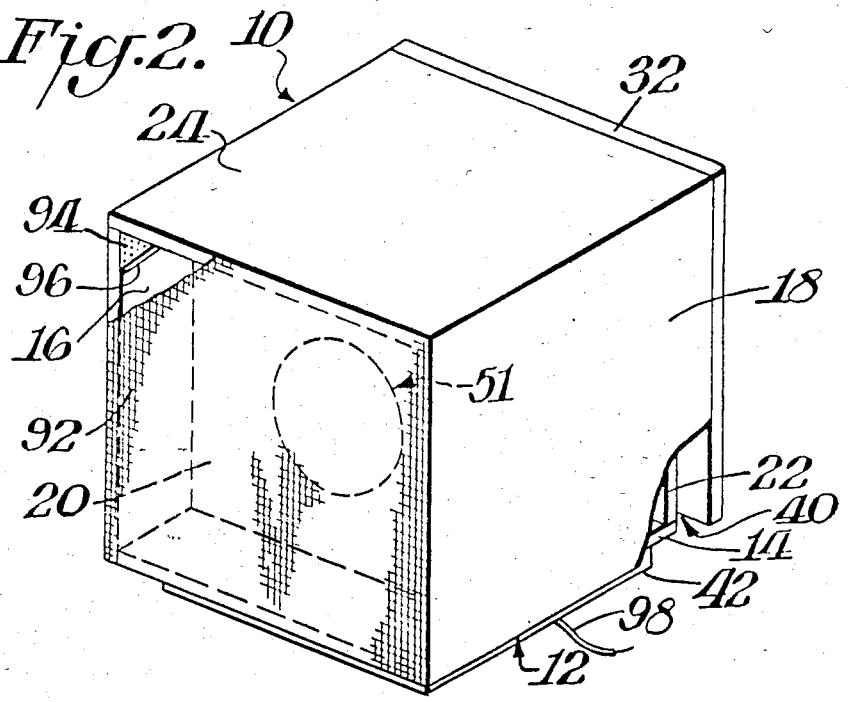
FIG. 2 is an isometeric view, with parts broken away, of the sound reproducer of FIG. 1 as it is arranged for operation.

Turning now to the drawings, FIGS. 1 and 2 show a sound reproducer 10 for woofer frequencies. This reproducer consists of a box 12 having a floor panel 14 and four upright walls 16, 18, 20 and 22 on which walls a top panel 24 is secured. Walls 16 and 18 connect opposite edges of the floor and top panels, but wall 20 is recessed in the box to provide an open outer chamber 26.

Top panel 24 is in one direction a little larger than floor panel 14, and thus provides a short overhang 28. Wall 22 is secured in upright position with respect to the corresponding edge 30 of the floor panel, and an extra outer wall 32 is mounted in spaced relation to wall 22 by being secured to the edge 34 of overhand 28 as well as to side walls 16, 18.

The foregoing combination provides an enclosed central chamber 36, and a separate open-bottomed sound-directing chamber 38 with a sound-discharging mouth 40 at its bottom. Box 10 is supported by a short hollow pedestal frame 42 secured to the lower face of floor panel 14 and recessed from all its side faces.

Wall 20 has a large circular cut-out 44 into which is fitted a mated pair of loudspeakers 51, 52. Each of these speakers has a mounting frame 54 with an out-turned flange 56 to which is cemented the usual annular mounting pad 58 and resilient ring that resiliently holds the outer edge of a speaker cone 62. Flange 56 merges into a generally cylindrical section 64 of the frame, and this section 64 of speaker 52 is shown as fitted into cut-out 44. A set of bolts 66 penetrate the thickness of wall 20 as well as aligned mounting holes in flanges 56 to secure the speakers in place face-to-face, with the help of nuts 68.

Speaker frames 54 are preferably of metal and have large windows 70 to expose the outside of their cones to the ambient air. In addition cone 62 of speaker 52 has a number of spaced openings 72 punched out of its side. These openings can have a circular, rectangular, oval, or any other general outline and can be from about ½ inch to about 1½ inches in width. Also the small ends 74 of both cones are linked together by a light-weight tube 80 of paper for example, extending between and cemented to those ends. The ends of tube 80 can be just large enough in diameter to fit snugly around or inside the end of the voice coil form 82 to which the cone is secured.

Wall 22 has a cut-out opening 84 even larger than opening 44. Across this opening is cemented a resilient supporting ring 86 that holds a diaphragm panel 88 so that it vibrates when very low frequency sounds impinge on it. The diaphragm panel 88 is preferably of such mass as to significantly reduce the travel of the speaker cones at the lowest frequencies. A disc of pressed wood weighing at least about ⅛ gram per square centimeter of area that it spans, is a very effective diaphragm when resiliently mounted at its edges.

The open face 90 of chamber 26 can be covered by speaker grill cloth 92 which can be secured in place by its edges although face 90 may remain uncovered in use. When a grill cloth is applied, Velcro type fastener strips 94 can be cemented to the corners of the mouth, preferably over wedges 96 cemented just inside those corners, and mating strips sewed to the inner face of the grill cloth at its corners. If desired two-faced pressure-sensitive tape can be used instead of the Velcro type fasteners.

Mouth 40 faces downwardly and is close to the surface on which box 10 is placed, so that this mouth needs no cover. Grill cloth 92 need not be very strong, inasmuch as it does not serve as significant protection for the delicate speaker cones.

Such a speaker combination reduces the volume equivalent compliance of the combination so that enclosed chamber 36 may be optimally reduced to half the otherwise required volume. Also, in a stereo system the bass frequencies may be added together mechanically by application of right and left low frequency signals to the terminals of speakers 51 and 52 respectively with the phasing connection to 51 reversed relative to 52. This maintains complete electrical isolation between channels. The push-pull symmetric nature of the combination significantly reduces asymmetric cone motion and therefore reduces asymmetric distortion in a manner similar to the reduction achieved by push-pull type electronic amplifiers.

With cones so coupled such that no motion of a single cone relative to the other is possible, and with one cone vented to the chamber in the box, the possibility of resonances in the frequency range from 200 to 1000 hertz is eliminated. Prior art configurations with face-to-face drivers and a sealed inner air volume between cones as the coupling medium, as in U.S. Pat. No. 4,016,953, present resonance problems in this range.

The cones need not be identical to each other and need not be driven by identical drivers, but identical speaker constructions are less expensive to manufacture.

A very effective woofer unit 10 has its height, width and depth, without pedestal 42, each about 18¾ inches measured on its exterior surfaces, with speakers 51, 52 identical to each other, both having 10 inch frames, a total Q ($Q_T$) of about 0.4 and a resonant frequency below 30 hertz. The walls of the box structure should be rigid enough so that they are not vibrated by the sounds generated at the speakers, and preferably made of particle board at least about ⅝ inch thick.

Co-acting with the foregoing speakers, vibratory diaphragm panel 88 is preferably a disc about 11 inches in diameter, and chamber 38 between 1 and 2, preferably about 1½ inches thick. A pedestal 42 also about 1½ inches high, or somewhat higher, is enough for use on floors covered with deep-pile rugs.

The top as well as sides of box 10 can be covered, as with cushiony material, and whether or not so covered is strong enough to serve as a rugged table top, and can be sat on or stood on by even heavy people without damage. The completely equipped box can weigh as much as 40 or more pounds. A lead such as twin speaker wires 98 can enter chamber 26 via a hole drilled in floor 14. Where crossover or compensation circuits are used, their components can be mounted on the floor of chamber 26, and an additional hole through wall 20 permits running leads to the inner speaker 52.

Figure 2A:
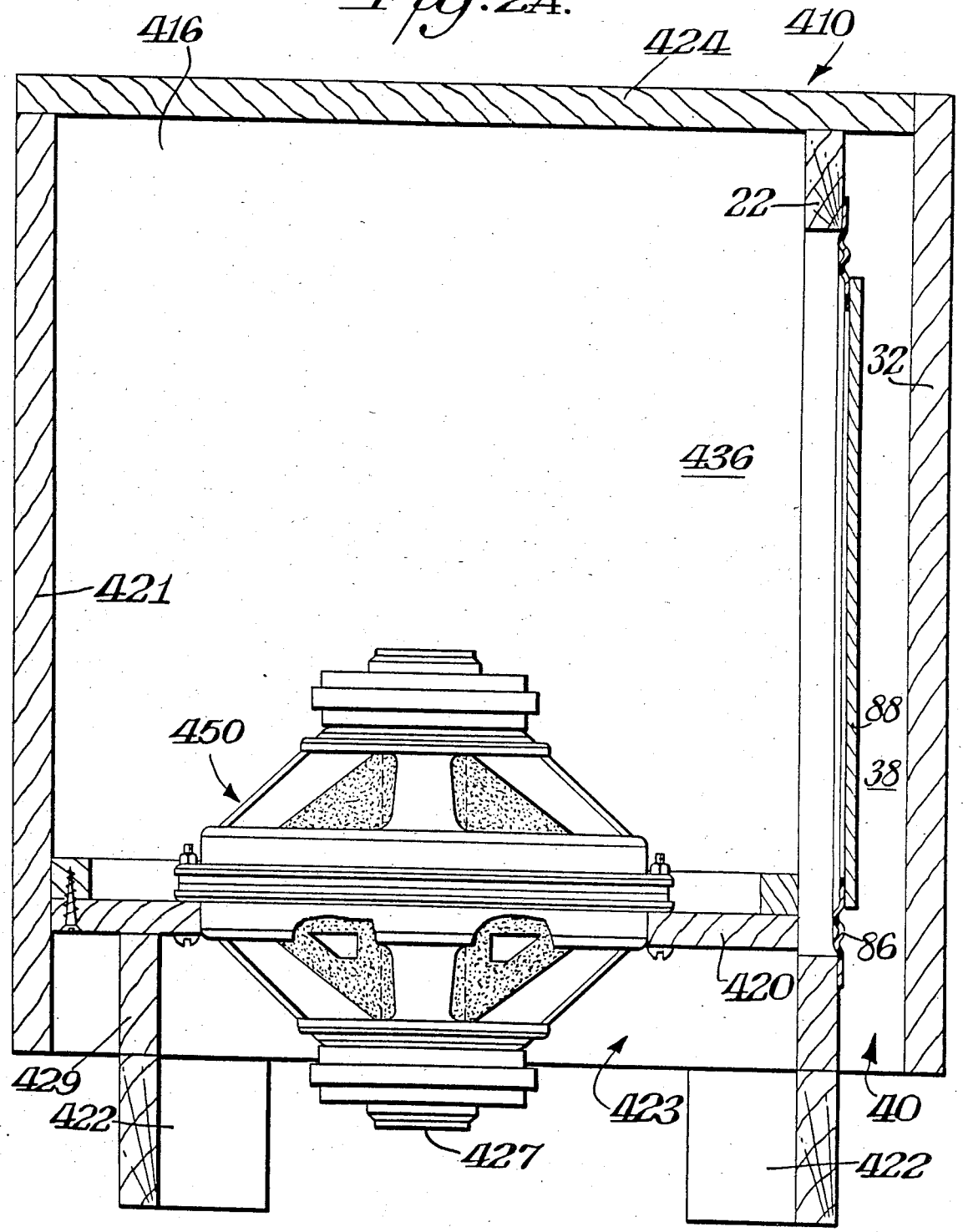
FIG. 2A is a view similar to that of FIG. 1, showing a modified form of the construction.

FIG. 2A shows a modification of the foregoing combination in which the speaker pair is shifted so that they fire vertically. Thus the speaker pair 450 can be identical to the corresponding pair in FIG. 1, but are held in box 410 on a wall 420 horizontally oriented and secured to side wall 416 as well as on opposing side wall (not illustrated), side wall 421, and internal vertical wall 22.

The bottom of the box below wall 420 is wide open at 423 and the lower speaker can extend to below that bottom as indicated at 427, although this is not necessary. Spaced feet 442 are fitted to the bottoms of the side walls, and if desired a bracing insert 429 can help support some of the feet against wall 420. Where such a bracing insert is used it can be perforated so as to permit woofer sound to pass through it fairly easily. Feet 442 should be long enough e.g. about two to two-and-a-half inches, to make sure the lowest portion 427 of the speaker is somewhat higher than the bottoms of the feet, and preferably at least about 1 inch higher. The foregoing feet height also provides ample clearance below box 410 to permit essentially free dispersal of the woofer sound around the box exterior, even when the box stands on a rug with one-inch high pile. Indeed such pile, or even shorter pile, helps with the sound distribution from the woofer assembly by absorbing and thus filtering out some of the higher frequencies that are not fully attenuated by whatever cross-over network or other supply source is used to feed the woofer speakers. Direct feeding of an untreated amplifier out is also suitable inasmuch as the high frequency attenuation by a rug leaves an acceptable woofer output.

Another feature of the construction of FIG. 2A, is that it is extremely rugged. All four sides as well as the top are rugged wood or particle board or the like so that the speakers themselves cannot be injured by inadvertent bumping or poking or upsetting or the like. Also the low location of the speakers makes the FIG. 2A construction difficult to tip over.

Electrical leads to the structure of FIG. 2A can also be directly run through its open bottom, and compensating circuit components as well as fuses mounted on the inside surfaces of its side walls below 420 so that they can be readily serviced yet are not exposed. Fuses may be externally mounted if kept sufficiently far from the edge to prevent accidental damage.

Figure 3:
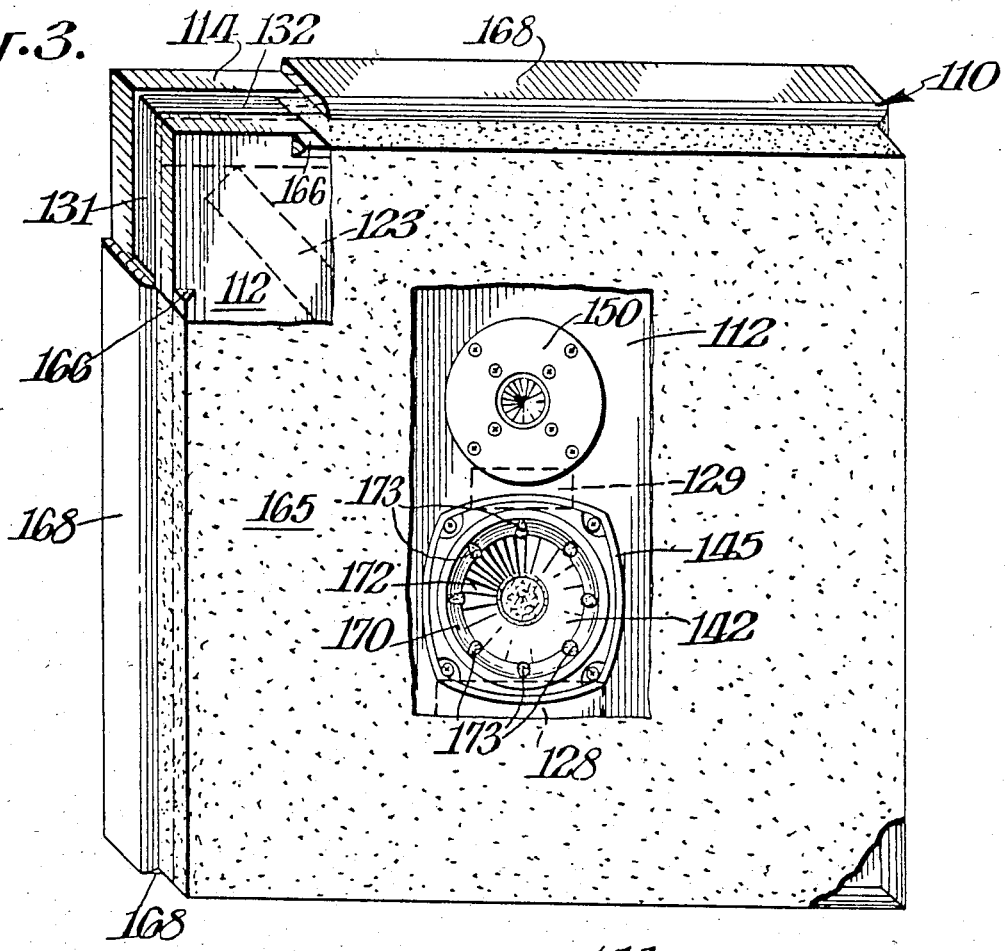
FIG. 3 is an isometric view of a sound reproducer used to reproduce sounds having frequencies higher than that of a woofer, as illustrated in the parent application.
Figure 4:
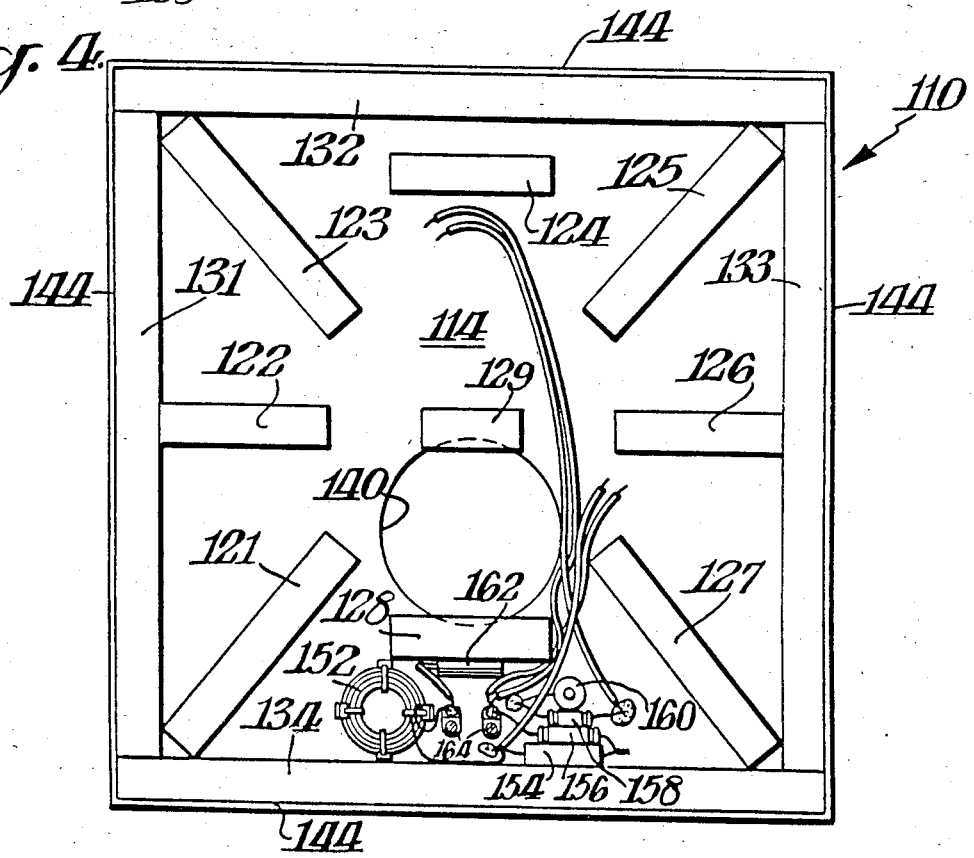
FIG. 4 is a plan view of the loudspeaker of FIG. 3 with its face board removed.

FIGS. 3 and 4 illustrate a sound reproducing combination in the general form of a shallow box 110. The box has a facing panel 112, a rear panel 114, and a set of inner spacers 121, 122, 123, 124, 125, 126, 127, 128 and 129, and outer spacers 131, 132, 133 and 134 sandwiched between the panels. A pocket 140 is routed out of the inner surface of the rear panel to receive the rear portion of a mid-range speaker 142. As shown by the narrow peripheral margin 144, the outer spacers 131, 132, 133 and 134 have their outer edges recessed inwardly from the outer edges of the rear panel.

Speaker 142 is mounted inside an opening in the face panel 112, and has a frame with a peripheral flange 145 that is screwed or bolted to the outer face of that panel. The overall depth of the speaker is about two inches so that the panels and the spacers can each conveniently be from about $\frac{5}{8}$ to about $\frac{3}{4}$ inch thick pieces of particle board to provide a speaker-accommodating pocket 140 that does not penetrate completely through the rear panel.

A tweeter speaker 150 is mounted in another opening in face panel 112 near mid-range speaker 142. Inasmuch as tweeter speakers are quite shallow in overall depth, no pocket is needed in rear panel 114 to accommodate speaker 150. The hollow interior of box 110 provides between the spacers, ample room for locating crossover and/or compensation circuits, such as is shown in FIG. 4 by the circuit components 152, 154, 156, 158, 160 and 162. These are appropriately wired together, to the leads of the speakers, and to incoming terminals 164 that are bolted through the rear panel. The components can also be fixed in position as by cementing or clamping them in place.

Before completing the assembly of the structures, a caulking or similarly soft filler material is placed in pocket 140, so that the rear of speaker 142 presses against such soft filler and thus supports and strengthens the relatively thin wall at the bottom of the pocket, and keeps it from vibrating in resonance to the sounds generated by the speakers. The remainder of the panels, and the spacers, are too thick for such vibration, and need no further attention in this respect.

In addition 70–90% of the internal air space is filled with a sound absorbing material such as fiberglass fibers to further reduce internal resonances.

The combination of FIGS. 3 and 4 does an extremely good job of reproducing sound frequencies above about 200 Hertz, with a mid-range speaker having a frame no larger than $4\frac{1}{2}$ inches, a cone that resonates at about 70 Hertz, and a $Q_T$ of from about 0.5 to about 1, where the face of the box extends laterally at least about seven inches from the cone of speaker 142, for about three-fourths of the cone perimeter. For the remaining one-fourth of the cone periphery, that face extends out at least 4 inches from the cone. This is accomplished by dimensioning the face panel so that it is about 18 inches by 18 inches or slightly smaller, and having speaker 142 offset about two inches from the center of that panel.

A mounting loop can be fixed to the rear surface of rear panel 114, so that the box can be readily hung on a wall that is provided with a conventional picture hook. Hanging the box in this way so that its tweeter is about four to five feet up from the floor, is preferred. The box is so thin and blocks all sound directed backwardly from its speakers, so that when so hung the sound propagated forwardly behaves very much like that from a speaker on a planar baffle of infinite size.

The front face of box 110 is shown in FIG. 3 as planar, but if desired that face can be made frusto-conical with speaker 142 at the frustum. The thickness of the box can then taper down from a maximum of about two inches at speaker 142 to a thickness of as little as a half inch or so at the box periphery. Such a tapered construction may be more conveniently made in the form of a disc, as in FIG. 3I of U.S. Pat. No. 3,964,571 so that the box has a generally circular outline. Box 110 can also be made with a circular outline and without the tapered thickness, if desired.

In FIG. 3, box 110 is shown as having its face covered with grill cloth 165 that is stretched over a marginal stand-off frame of quarter-round rods 166. The margins of the grill cloth are secured as by stapling to the exposed faces of outer spacers 131, 132, 133 and 134, and the secured edges covered by trim strips 168 that span across the outer edges of the rear panel as well as of the foregoing spacers. Using a grill cloth that has a stretch weave enables it to be more readily and neatly stretched over and around corners.

For best results with the mid-range speaker, it is treated to spot stiffen the resilient ring 170 that resiliently holds the outer margin of its cone 172. During operation there is a tendency for local resonances to cause ringing instead of abrupt sound decay, and thus distort the generated sound. Applying adhesive dabs 173 about $\frac{1}{4}$ inch in diameter about 1 inch apart on the resilient ring 170 where it is cemented to the cone, significantly reduces this type of distortion. Any adhesive can be used, even those like rubber cement that leave a resilient deposit. A heavy deposit of resilient rubber on a spot of the ring very effectively reduces the resiliency of that spot as compared to the remainder of the resilient ring. The dabs can vary in width from about $\frac{1}{8}$ to about $\frac{3}{8}$ inch, and can if desired be placed as much as two inches apart although such spacing might not always provide the desired damping. With some speakers little or no spot stiffening is needed, but such stiffening does not detract from their output even though it is not needed. In general the best results are obtained where the cone of speaker 142 is made of paper and the resilient surround is cloth rather than foam.

Figures 5, 6:
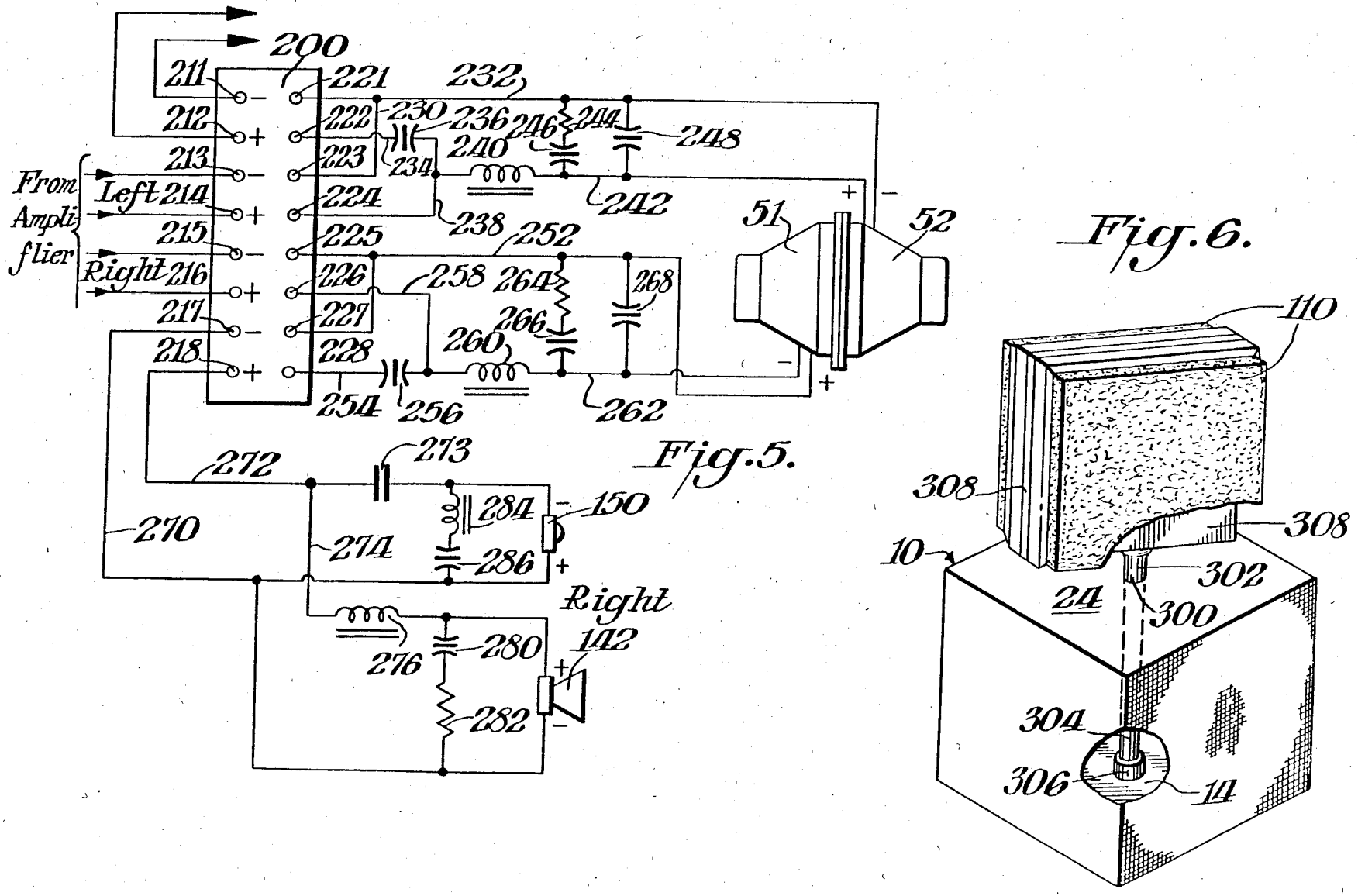
FIG. 5 is a schematic diagram of a circuit of the present invention for supplying to the sound reproducers of FIGS. 1 and 3 the electric signals to be reproduced.
FIG. 6 is an isometric view of a particularly desirable combination of the sound reproducers of FIGS. 1 and 3.

The circuit diagram of FIG. 5 illustrates an effective cross-over and compensation network that coacts with the various speakers of FIGS. 1 and 3 or FIGS. 2A and 3, to produce excellent sound reproduction from electrical signals delivered by an amplifier having a stereo output each channel of which has an eight ohm output impedance.

A terminal board 200 which can be mounted in the woofer box 10, has a series of eight external connector terminals 211, 212, 213, 214, 215, 216, 217 and 218, and a companion series of eight internal connector terminals 221, 222, 223, 224, 225, 226, 227 and 228, each of which is conductively linked to its companion terminal. Leads from the left stereo channel are connected to terminals 213, and 214, while leads from the right stereo channel are connected to terminals 215 and 216. The phasing of the leads is shown by the plus and minus marks.

Conductor 230 connects terminal 223 to conductor 232 which runs from terminal 221 to the minus terminal of speaker 52. Conductor 234 connects one terminal of bipolar electrolytic cross-over capacitor 236 to board terminal 222, while conductor 238 connects the other terminal of capacitor 236 to board terminal 224. Also connected to conductor 238 is one terminal of cross-over inductor 240, the other terminal of which ties through conductor 242 to the plus terminal of speaker 52. A very effective cross-over frequency of about 200 hertz is provided by a capacitor 236 of 100 microfarads, and an inductor 240 of 6.8 millihenrys having a maximum of about 0.5 ohm resistance, where speaker 52 has a voice coil of 7 to 8 ohm impedance. As a matter of precaution capacitor 236 can have a 100 volt operating potential, in which case it is preferably a non-polarized electrolytic capacitor or a parellel pair of 50-microfarad 100-volt non-polarized electrolytics.

Between conductors 232 and 242, there is connected a compensation network consisting of a series-connected resistor 244 and capacitor 246, along with a bridging capacitor 248. With a speaker 52 having the foregoing impedance, a very effective value for resistor 244 is 7.5 ohms, while capacitor 246 is 50 microfarads and capacitor 248 is 33 microfarads. These two capacitors need not be rated for operation at voltages greater than about 50 volts, although ratings as high as above 200 volts max may be used.

The combination of resistor 244 and capacitor 246 provides a high pass electrical impedance whose time constant is computed to match the time constant of the electrically inductive and resistive components of the voice coil in speaker 52. This provides a desirable constant load for crossover elements consisting of capacitor 236 and inductor 240 and greatly enhances their operation.

Where speaker 51 has about the same voice coil impedance as speaker 52, its crossover and compensation network components 256, 260, 264, 266 and 268 and wiring 252, 254, 258 and 262 can be exactly the same as the corresponding parts for speaker 52. However the conductors 252, 262 are connected in opposite phase with respect to the terminals of speaker 51.

FIG. 5 also shows a very desirable crossover and compensation network for a set of speakers 142, 150 that reproduce the higher frequency sounds in one of the stereo channels. The other stereo channel can be identically treated. For the illustrated network, conductor 270 ties minus terminal 217 directly to the minus terminal of speaker 142 as well as to the plus terminal of speaker 150. Conductor 272 leads from plus terminal 218 through conductor 274 and inductor 276 to the plus terminal of speaker 142. Conductor 272 also connects through capacitor 278 to the minus terminal of speaker 150. Across the terminals of speaker 142 is bridged a series-connected capacitor 280 and resistor 282, while bridged across the terminals of speaker 150 is a series-connected inductor 284 and capacitor 286. Series connected capacitor 280 and resistor 282 perform the same compensation function for mid-range speaker 142 as resistor 244 and capacitor 246 provide for woofer speaker 52. Series connected inductor 284 and capacitor 286 compensate for the fundamental resonance of speaker 150. Compensation of a tweeter with such a series connected bridge has been found to give particularly good square wave response in a microphone, as well as improved sound reproduction.

With the voice coil of speaker 142 of about 7.5 ohms impedance, and that of speaker 150 of about 6.8 ohms impedance, a four-microfarad capacitor 278 and a 0.37 millihenry inductor 276 wound from 18 gauge copper wire provide a desirable cross-over at about 4500 hertz. As diagrammatically indicated, capacitor 278 need not be a non-polarized electrolytic; it is preferably a polyester film capacitor. The compensation network for speaker 142 can have its capacitor 280 of 10 microfarads rated for 50 volt operation and its resistor 282 a 7.5 ohm 10 watt resistor. Speaker 150 has its leads inverted and in addition its compensating network includes a capacitor 286, preferably a 20 microfarad 50 volt capacitor, in series with inductor 284 preferably a 1.8 millihenry 5.6 ohm inductor. This compensation is suitable where the tweeter is mechanically resonant at about 900 hertz, and has a soft dome construction, a 9 ounce magnet, and an aluminum coil bobbin. Capacitor 286 and inductor 284 should resonate at the mechanical resonance frequency or within or about plus or minus 10% of that frequency, and the resistance of the compensation circuit can if desired be further selected to provide minimum ringing. Such selection is best made by trial and error measurements, using different capacitance and inductance values that maintain the foregoing electrical resonance.

The quality of the sound reproduction of the present invention is even further improved when instead of having one FIG. 3 box per stereo channel with that box mounted on the wall of a room, two such boxes are mounted back-to-back spaced from a wall. Thus a simple stand can be provided with a thin upright holding hooks at the desired height on its opposite faces, and separate boxes mounted on the respective hooks. Both such boxes should then have the voice coils of their corresponding speakers connected to receive the electrical signals for the same stereo channel, but the crossover network 256, 260 having its values modified to allow for the extra speakers. Where the speakers added for the doubling are identical with the single set of speakers, it is enough to merely double the capacitance of cross-over capacitor 256. Crossover networks can also be built into the outputs of amplifiers, if desired.

Alternatively when doubled boxes are used, their speakers can have voice coils with twice the impedance of that for a box when used alone. No changes are then needed in the crossover network.

The foregoing box doubling can be effected with either channel alone, or with both channels, and the doubled boxes for any channel can have their outputs in phase. A set of such doubled boxes can also be mounted on the top panel 24 of the woofer box 10, or the individual boxes of the pair mounted on adjacent side panels of the woofer box.

FIG. 6 diagrammatically illustrates a very desirable speaker combination according to the present invention. Here a bass box 10 has an opening 300 in its upper panel 24, and a paddle-shaped upright 302 is fitted into that opening. The lower portion of upright 302 is rod-shaped as at 304 and is seated in a socket 306 secured to floor panel 14 of the construction of FIG. 1 or to the top of the speaker pair in the construction of FIG. 2A. The upper portion of the upright is shaped like a board 308 having the height and width of a speaker box 110. Two such boxes are hung, one each on the respective faces of board 308, as by recessed hooks. Opening 300 can be made so tight fitting with respect to rod 304 as to keep the upright from rotating in its socket unless forcefully moved.

Placing box 10 so that its mouth 90 faces a wall of a room and is at least about 6 inches, preferably 8 to 12 inches, from that wall, then permits adjustment of the upright so that its upper portion does not obstruct any desired view or interfere with movement around it. Another pair of back-to-back boxes 110 can then be provided on a different support to complete the stereo sound reproduction. A second bass box 10 is not needed inasmuch as no significant stereo perception is obtained from the bass sounds. Thus arranged, performance even better than that of the wall mounted unit is achieved. The output of the rear speaker of such a back-to-back pair behaves like a reflection from the front speaker when the front speaker is hung on a wall and so provides a response similar to that of the wall-mounted unit, but the back-to-back pair yields significantly greater reverberant sound adding a desirable increase in perceived depth and imaging.

Where a bass box 10 is in contact with upper range box 110, the running of the wires to the boxes is somewhat simplified. Thus in FIG. 6 the leads to boxes 110 can run down a groove in the face of the upright rod 304, or can run through a passageway drilled through that rod, and thus be directly connected to a supply network that can be mounted in box 10.

Figure 7:
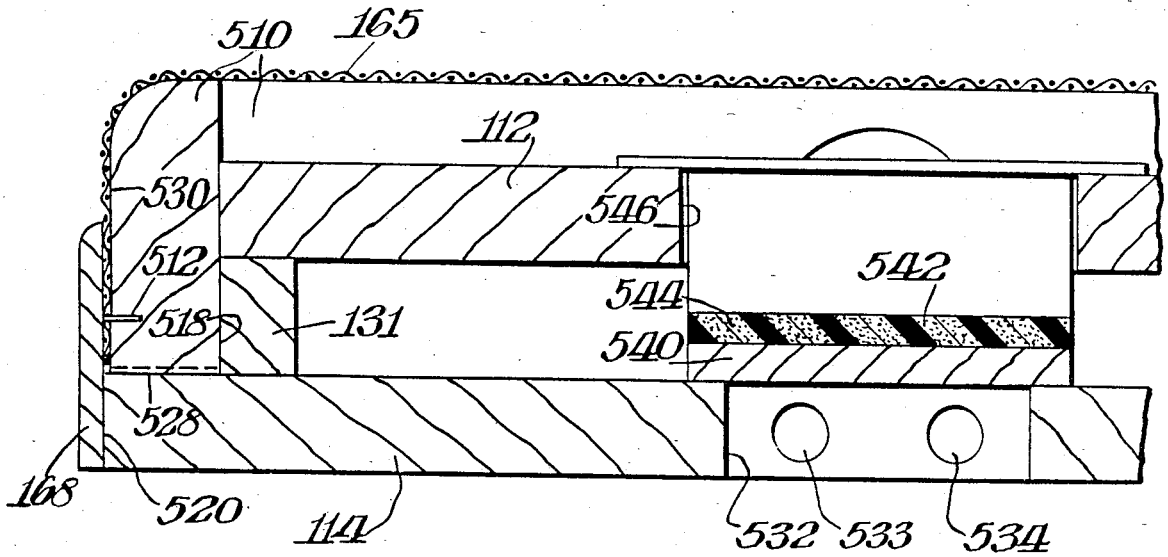
FIG. 7 is a fragmentary view similar to that of FIG. 3 showing a modified construction according to the present invention.

FIG. 7 shows a modification of the construction of FIG. 3, in which modification the grill cloth 165 is not directly secured to the panel assembly. Instead the grill cloth is stretched over a pre-assembled self-supporting frame made of four frame members 510 and dimensioned to closely fit around the side edges of face panel 112. The grill cloth can be fastened to the self-supporting frame as by staples 512, and this combination then slid in place about the face panel. The edge spacers such as 131 can be located so as to provide outer edges 518 flush with the outer edges of the face panel, while back panel 114 can have its edges 520 extend outwardly far enough to be generally flush with the grill cloth carried on the outer faces 530 of its slide-fitted frame. The trim strips 168 can be secured as by nailing to the back panel, and if desired removably secured to the slide frame as by screws. Alternatively the grill cloth can be wrapped further around its slide frame members and stapled to their inner edge faces 528, in which event the trim strips can be eliminated.

In the FIG. 7 modification the grill cloth with its slide frame is readily removable so that the speakers covered by the cloth are more conveniently serviced when needed.

Also in the interest of serviceability, back panel 114 can be recessed to receive fuses inserted in series the voice coil connections to the respective speakers in the construction of FIGS. 3 or 7. In FIG. 7 a hole 532 is cut completely through the back panel under the tweeter 150, and a pair of fuses 533, 534 fitted in sockets mounted in that hole with leads extending into the space between the face and back panels. Hole 532 is securely covered as by a plywood block 540 that can be wedged in place by the back 542 of the tweeter with or without the help of a resilient spacer 544 of compressed yieldable plastic foam. Block 540 can also be screwed in place with the screw heads accessible through the opening 546 in which the tweeter is fitted in face panel 112. Spacer 129 can be omitted in such a combination.

The arrangement of FIG. 7 can thus have its back panel held directly against the wall of a room when no servicing is needed. It is also helpful to have the equalizing circuit components for the mid-range and tweeter speakers fitted between the face and back panels adjacent hold 532, so that these components or at least their connectors, can be reached through that hole with or without also reaching through hole 546. A defective component can then be replaced or merely have its connector cut, and a new component placed alongside and connected into the appropriate circuit. These components should be securely mounted so that they are not vibrated by the outputs of the speakers.

Figure 8:
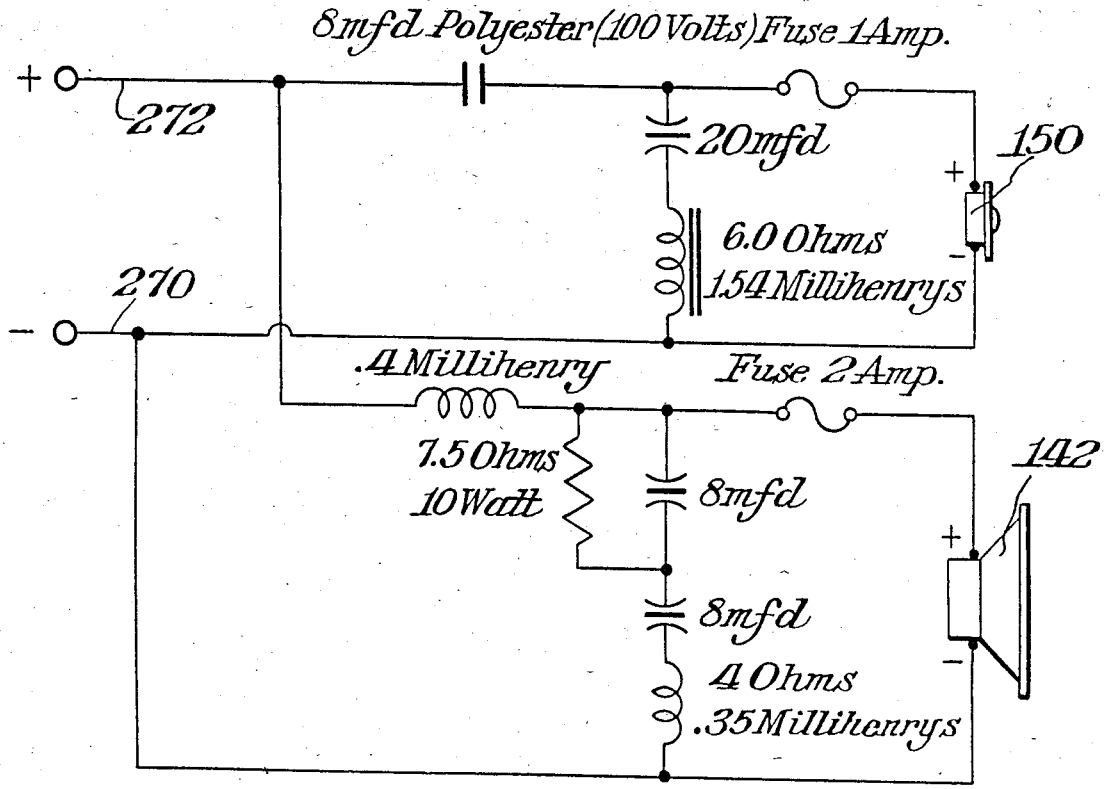
FIG. 8 is a circuit diagram of a modified mid-range and tweeter compensation network according to the present invention.

FIG. 8 shows a cross-over and compensation network that functions even better for the mid-range and tweeters, than the corresponding portion of the FIG. 5 circuit. The component characteristics are set out in the figure, but each can be varied plus or minus 10%. The fuses are not needed for the proper electrical operation, and can be omitted where there is no danger of having the speakers burn out. 2½ ampere fuses can also be inserted in the corresponding locations for speakers 51 and 52.

Obviously many modifications and variations of the present invention are possible in light of the above teachings. It is therefore to be understood that within the scope of the appended claims the invention may be practiced otherwise than as specifically described.

What is claimed:

1. A loudspeaker combination having an essentially rigid generally rectangular box, the height, width and depth of which are each between about 15 and about 21 inches, the bottom of the box being essentially open and fitted with spaced feet on which the box can stand on a pile rug without materially blocking the emergence of sound generated within the box, the top and all sides of the box being essentially imperforate essentially rigid walls which essentially do not transmit sound, a woofer sound generator mounted within the box, and also inside the box a generally vertically extending partition that forms a generally vertically extending open-bottomed compartment about 1 to 2 inches thick, connected as a duct to conduct and discharge the lowest frequency sounds generated by the woofer.

2. The combination of claim 1 in which the partition includes a resiliently-mounted passive resonating panel open to the sounds generated by the woofer and sufficiently large to generate in the duct those sounds having the lowest frequencies.

* * * * *